US006742989B2

(12) United States Patent
Osako et al.

(10) Patent No.: US 6,742,989 B2
(45) Date of Patent: Jun. 1, 2004

(54) STRUCTURES OF TURBINE SCROLL AND BLADES

(75) Inventors: Katsuyuki Osako, Nagasaki (JP); Shozo Maekawa, Sagamihara (JP); Motoki Ebisu, Sagamihara (JP); Ryoji Utsumi, Nagasaki (JP); Takashi Mikogami, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/270,541

(22) Filed: Oct. 16, 2002

(65) Prior Publication Data

US 2003/0077170 A1 Apr. 24, 2003

(30) Foreign Application Priority Data

Oct. 19, 2001 (JP) ..... 2001-321416
Dec. 10, 2001 (JP) ..... 2001-376050

(51) Int. Cl.[7] ..... F01D 5/14; F01D 25/24

(52) U.S. Cl. ..... 415/205; 415/204; 415/211.1; 415/212.1; 416/185; 416/188; 416/223 A; 416/223 B; 416/228; 416/235

(58) Field of Search ..... 415/204, 205, 415/212.1, 211.1; 416/185, 188, 223 A, 223 B, 228, 235, 237, DIG. 2; 417/407

(56) References Cited

U.S. PATENT DOCUMENTS 3,032,315 A * 5/1962 Birmann ..... 415/204
3,734,650 A * 5/1973 Reisacher et al. ..... 415/205
3,785,128 A * 1/1974 Redemann ..... 415/205
4,147,467 A * 4/1979 Leicht et al. ..... 415/205
4,597,926 A * 7/1986 Ando et al. ..... 416/241 B

FOREIGN PATENT DOCUMENTS

DE 1296875 A * 6/1969 ..... 415/204
JP 61-94201 U * 6/1986 ..... 415/205
JP 63-45001 U * 3/1988 ..... 415/205
JP 1-211605 A * 8/1989 ..... 416/223 A
JP 5-340265 A * 12/1993 ..... 415/205
JP 8-49696 A * 2/1996 ..... 415/205
JP 9-144550 A * 6/1997 ..... 415/205
JP 11-190201 A * 7/1999 ..... 415/205

* cited by examiner

*Primary Examiner*—Christopher Verdier
(74) *Attorney, Agent, or Firm*—Oblon, Spivak, McClelland, Maier & Neustadt, P.C.

(57) ABSTRACT

The improvements are made in the turbine scroll and the turbine blades. The scroll structure for the radial turbines is characterized by the foregoing scroll having a scroll width ratio between the width in the radial direction (ΔR) and the width in the direction of the rotation (B) ranging from ΔR/B=0.3 to 0.7. It is further characterized by the configuration in which the turbine blades have cut-away areas at the blade corners by a prescribed amount, which are provided on the inlet edge at the shroud side and hub side where the operating gas flows.

6 Claims, 17 Drawing Sheets

(B)

(A)

FIG. 6(A)
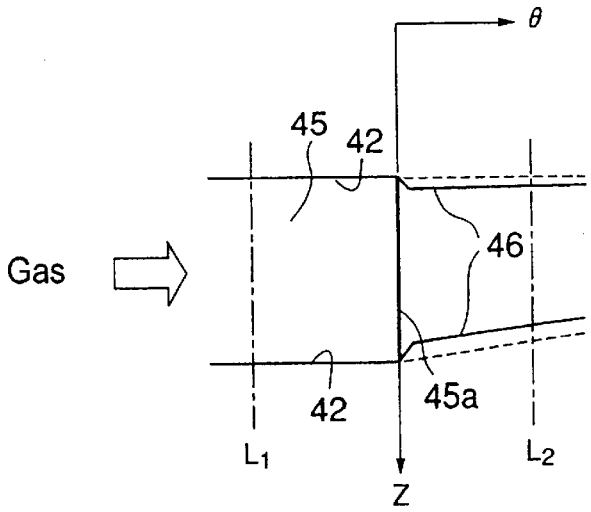
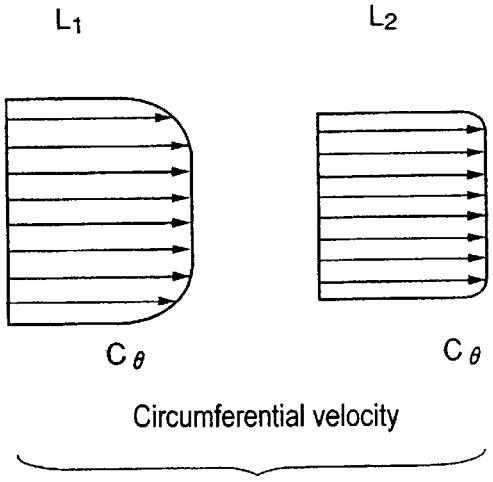
FIG. 6(B)
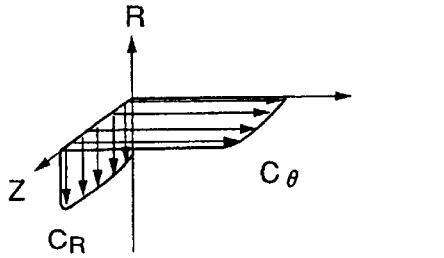
Inhibiting the developtment
of a three dimensional boundary layer
FIG. 6(C)

FIG. 16(A) Prior Art
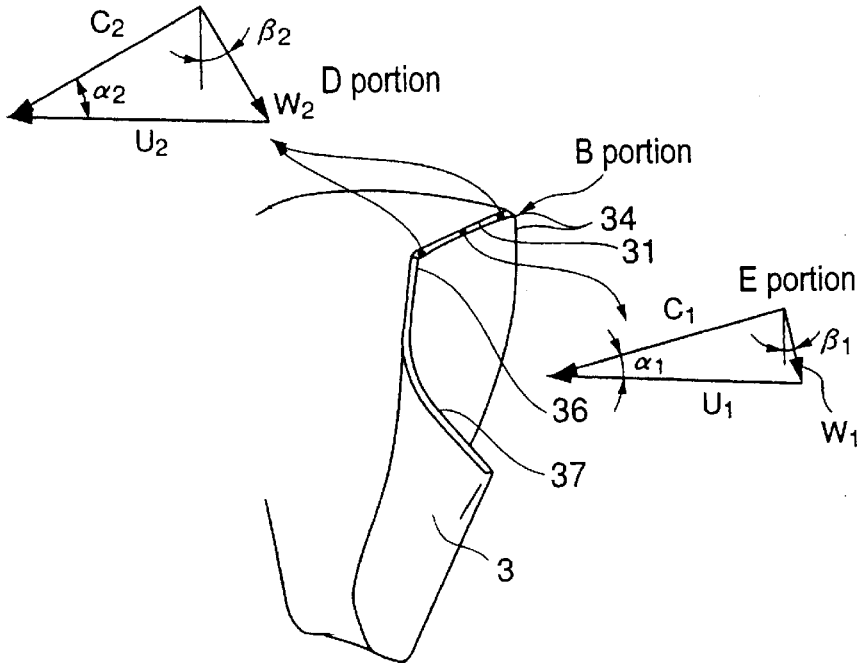
FIG. 16(B) Prior Art
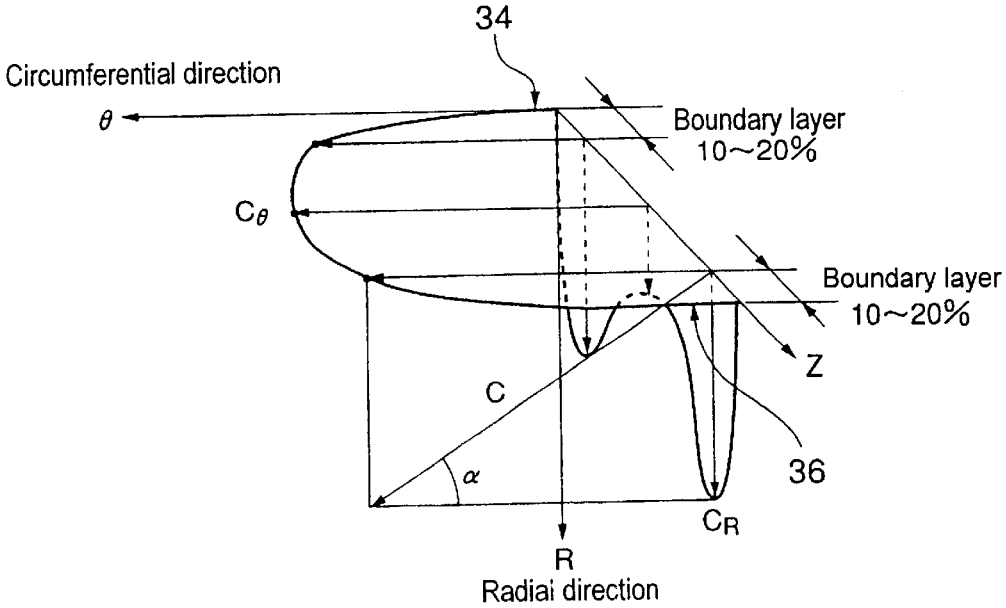

STRUCTURES OF TURBINE SCROLL AND BLADES

BACKGROUND OF THE INVENTION

1. Field of the Invention

The present invention relates to structures of turbine scroll and blades. The turbine scroll forms the gas flow path for radial turbines used in turbochargers for internal combustion engines (exhaust gas turbocharger), small turbines, expansion turbines, etc., wherein the operating gas flows onto the turbine blades on the turbine rotor from the vortex-shaped scroll in the radial direction to impart rotational drive to said turbine rotor. The turbine blades are fixed on a rotor shaft for the compressor.

2. Description of the Related Art

Radial turbines are widely used in the relatively compact turbochargers (exhaust gas turbochargers) used in automobile engines and the like. The operating gas for the turbine flows in the radial direction from the vortex-shaped scroll formed inside the turbine casing to the turbine blades, causing the rotation of said turbine rotor, before flowing in the axial direction.

FIG. 11 shows an example of a turbocharger using a radial turbine. In the Figure, 1 represents the turbine casing, 4 the vortex-shaped scroll formed inside turbine casing 1, 5 the gas outflow path formed inside turbine casing 1, 6 the compressor casing, and 9 the bearing housing that links the turbine casing 1 and compressor casing 6.

Turbine rotor 10 has a plurality of turbine blades 3, which are evenly spaced and affixed to its outer circumference. 7 is the compressor, 8 the diffuser mounted at the air outlet of said compressor 7, and 12 is the rotor shaft that links said turbine rotor 10 and compressor 7. 11 is a pair of bearings mounted in the foregoing housing 9, which support the foregoing rotor shaft 12. 20 is the axis of rotation of the foregoing turbine rotor 10, compressor 7 and rotor shaft 12.

In turbochargers equipped with such radial turbines, exhaust gases from the internal combustion engine (not shown) enter the foregoing scroll 4, where they flow along the swirl of said scroll 4, which causes them to rotate as they flow in from the opening at the outside circumference of the turbine blades 3 toward said turbine blades 3 in the radial direction toward the center of turbine rotor 10. After performing the expansion work upon said turbine rotor 10, the gases flow in the axial direction outside of the device through gas outlet 5.

FIG. 12 is a structural diagram showing the foregoing scroll 4 and surrounding area in a radial turbine. In the figure, 4 is the scroll, 41 the outer circumferential wall of said scroll 4, 43 the inner circumferential wall, and 42 the side walls. Also, 3 represents the turbine blades, 36 the shroud side and 34 is the hub side for said turbine blades 3.

The width $\Delta R_0$ in the radial direction of scroll 4 is formed to be of approximately the same dimensions as the width $B_0$ in the direction of the axis of rotation (scroll width ratio $\Delta R_0/B_0=1$).

FIG. 13(A), FIG. 13(B) show the area around a tongue formed in inner circumference of the gas inlet to the radial turbine; FIG. 13(A) is a front view from a right angle to the axis of rotation, and FIG. 13(B) is a view in the direction of the arrows on line B—B of FIG. 13(A).

In the FIGS. 13(A), 13(B), 4 is the scroll, 44 is the edge surface of the opening to said scroll 4, 45 the tongue formed on the inside circumference of the gas inlet, 45*a* is the tongue edge, the downstream edge of said tongue 45, and 046 represents the tongue's downstream side walls, which are located directly downstream of tongue edge 45*a* of the foregoing scroll 4.

The width between the walls of said tongue's downstream side walls 046 is either the same as the width of the foregoing tongue edge 45*a*, or a width that has been smoothly constricted from tongue edge 45*a* to follow the shape of the scroll 4.

In the above described types of radial turbines, the gases inflowing into the vortex of the foregoing scroll are rotating as they flow into turbine blades 3, and the velocity distribution of the inflowing gas varies in the height direction (Z direction) of turbine blades 3.

To wit, due to the three dimensional boundary layer having a 15 to 20% height $B_3$ range at the foregoing input edge surface formed in the vicinity of inlet edge surface 31 (see FIG. 12) for the foregoing turbine blades 3, the foregoing gas inflow velocity C, as shown in FIG. 14, has a circumferential direction component having a circumferential velocity $C\theta$, which is greater at the center of the foregoing inlet edge surface 31, and which is lower at the square area on both ends of the blades 3, i.e. the shroud side 36 and the hub side 34. Also, as shown in FIG. 11, the radial direction component, which is the radial direction velocity $C_R$, has a distribution in the height direction, which is lower in the center of the foregoing inlet edge surface 31 and higher at both edges, i.e. the shroud side 36 and the hub side 34.

Then when distribution in the flow in the height direction at the inlet to the foregoing turbine blades 3 exists, in other words, when there is distortion in the flow, the flow loss at said turbine rotors increases, and this lowers the turbine's efficiency. To wit, the optimum relative angle of gas inflow $\beta_1$, along with relative angle of gas inflow $\beta_2$ between the walls of inlet edge walls 31, i.e. between the foregoing hub side 34 and shroud side 36, in the center of the inlet for turbine blades 3 increases, so that near the foregoing hub side 34 and shroud side 36, a difference develops in the relative angle of gas inflow $\beta$. In other words, as the gas impact angle (incidence angle) increases, the impact angle (incidence angle) also increases on the back side of turbine blades 3 from the gas (back pressure), which not only causes impact loss, but it increases the impact angle (incidence angle) at the foregoing hub side 34 and shroud side 36, which adds to the secondary flow loss between the turbine blades to thereby lower the turbine's efficiency.

On the other hand, in the foregoing scroll 4, which forms the inlet flow path to the turbine blades 3, the shape of the scroll 4 causes a three dimensional boundary layer to be produced. As shown in FIG. 15(B), the radial direction velocity $C_R$ in the height direction of turbine blades 3, shows a velocity distribution which is lower at the center of the foregoing inlet edge surface 31, and higher at the square areas on the two ends of the blades, in other words, on the shroud side 36 and the hub side 34.

However, as shown for the conventional scroll 4 in FIGS. 12 and 13:

(1) the cross-sectional shape of the flow path of scroll 4 is approximately square, with the width dimension in the radial direction $\Delta R_0$ being the same as the width in the direction of the axis of rotation $B_0$ (scroll width ratio $\Delta R_0/B_0=1$).

(2) In the area on both sides of scroll 4 which connect to around both edges of turbine blades 3, to wit the shroud side 36 and the hub side 34, the side walls have a smooth surface.

(3) The width Bo in the direction of the axis of rotation of the scroll 4 flow is formed to be either constant, or diminished slightly toward the inside circumferential side.

These result in the following types of problems:

Due to that structure, the above described three dimensional boundary layer is apt to form at the gas inlet to the foregoing turbine blades 3.

Further, in the area of the foregoing tongue 45, the difference in pressure above and below tongue 45 due to its thickness causes the generation of wake 50, as shown in FIG. 13(A). Then, as shown in FIG. 13(A) for the conventional technology, since width between the walls downstream of the tongue 046, being either the same as the width of the tongue edges 45*a* or gradually reduced from said tongue edge 45*a*, following the shape of scroll 4, generates no action that would reduce the foregoing wake 50. Accordingly, as shown in FIG. 15(A), this causes variation and distortion the radial direction velocity $C_R$ in the circumferential direction.

Thus, in the prior art, the shape of scroll 4 as stated above in (1), (2) and (3) causes a three dimensional boundary layer to be generated, which distorts the gas flow in the height direction of turbine blades 3 as the gas flows into the turbine blades, and this increases the flow loss to turbine blades 3, and thereby lowers the turbine efficiency.

Further, due to the structure of the side walls 046 downstream of the foregoing tongue edge 45*a* in the prior art, the thickness T of tongue 45 does not act to reduce the wake 50, and even further causes variation and distortion in the boundary layer of the radial direction velocity $C_R$ in the circumferential direction. This increases the scroll flow loss, and thereby lowers turbine efficiency.

On the other hand, since the shape of the aforementioned turbine blades 3 is such that the outside diameter of the inlet edge surface 31 maintains the same height across the shroud side 36, the center area, and hub side 34 as shown in the B portion shown in FIG. 16(A), the blades' circumferential velocity $U_2=U_1$. Because of this, the relative angle of gas inflow β in the height direction of the blades 3 differs. If, as shown in the E portion shown in FIG. 16(A), the relative angle of gas inflow $\beta_1$ is optimized in the center area, then, as shown in FIG. D portion in FIG. 16(A), the relative angle of gas inflow $\beta_2$ near the side walls, i.e. hub side 34 and shroud side 36, is greater than the relative angle of gas inflow $\beta_1$ at the center due to the flow distortion caused by the foregoing scroll 4. In the figures, $W_1$, $W_2$ are the relative gas inflow velocities, and $C_1$, $C_2$ are the absolute gas inflow velocities.

Due to this situation in the prior art, on the foregoing hub 34 and shroud 36 sides, the gas flow on the back side (negative pressure side) of the foregoing blades 3 came in at an impact angle (incidence angle) and not only generated an impact loss at the inlet to the turbine blades, but also increased the secondary flow loss inside turbine blades 3 due to the increase of the impact angle (incidence angle) on the forgoing hub 34 and shroud 36 sides, which facilitated diminished turbine efficiency.

SUMMARY OF THE INVENTION

The present invention was developed after reflection upon the problems associated with the prior art. The improvements are made in the turbine scroll and the turbine blades. The first object of this invention is to provide a scroll structure for radial turbines that inhibits the formation of a three dimensional boundary layer caused by the shape of the scroll at the inlet to the turbine blades, that reduces the flow loss to said turbine blades by preventing distortions from forming in the gas flow in the height direction of said turbine blades, and that additionally inhibits the scroll flow loss by reducing the formation of distortion in the radial direction velocity in the scroll flow path as means to improve turbine efficiency.

The second object of this invention is to provide turbine blades which can improve the efficiency of the turbine by making the relative angle of gas inflow at the inlet to the turbine blades uniform in the height direction of the blades and inhibiting the gas impact loss due to variations in the foregoing relative angle of gas inflow and the generation of secondary flows in the area inside the turbine blades.

To achieve the first objects mentioned above improving the shape of the scroll, a preferred embodiment of this invention provides radial turbines in which the operating gas flows through a vortex-shaped scroll formed inside the turbine casing to the blades of the turbine rotor positioned inside that scroll, flowing into said blades in a radial direction to rotate said turbine rotor before flowing out, in the axial direction, wherein the scroll structure for the radial turbines is characterized by the foregoing scroll having a scroll width ratio between the width in the radial direction (ΔR) and the width in the direction of the rotation (B) ranging from ΔR/B=0.3 to 0.7.

As shown in FIG. 1, by means of this invention providing that the scroll width ratio between the width of the scroll in the radial direction (ΔR) and the width in the direction of the axis of rotation (B) being ΔR/B=0.3 to 0.7, creates a situation where the total friction loss caused by the scrolls side walls and the inside and outside circumferential walls is approximately equivalent to that in the prior art where the width ratio was ΔR/B=1, but because the scroll shape has been flattened by lengthening width in the axial direction of rotation (B) to be approximately twice the width in the radial direction (ΔR), at the edge area of the blades (to wit, on the shroud side and the hub side) on the scroll side walls, the radial direction velocity ($C_R$) has been reduced over what it was in the prior art wherein the aforementioned scroll width ratio ΔR/B was approximately 1. This reduces the secondary flow loss inside the scroll.

It further serves to inhibit the development of a three dimensional boundary layer, which, as shown in FIG. 2, reduces the flow loss, especially the mixture loss to the turbine blades, by maintaining the distortion of the gas flow in the direction of the height of the turbine blades as it flows into the blades to thereby improve the efficiency of the turbine.

Another preferred embodiment of this invention is characterized by the foregoing scroll being structured in a manner such that the width in axial direction of rotation (B) expands at a fixed rate from the outside circumference in the radial direction toward the inside circumference.

Another preferred embodiment of this invention, is preferably, is characterized by the foregoing scroll's width in the direction of the axis of rotation (B) being formed so that the width in the axial direction of the inside circumferential edge ($B_2$) being 1.2 to 1.5 times the width of the outside circumferential edge ($B_1$).

According to this embodiment, the structure of the scroll is such that its width in the direction of the axis of rotation (B) is gradually expanded from outer circumferential side in the radial direction to the inner circumferential side, which, corresponding to the square areas on both ends of the blades (that is, on the shroud side and hub side), along both side walls of the scroll area, the velocity in the radial direction ($C_R$) is gradually reduced as the gas approaches the turbine blades, which causes a more uniform distribution of the velocity in the radial direction ($C_R$), in comparison to the reduction achieved in the prior art by using a constant scroll width.

This structure inhibits the development of a three dimensional boundary layer, and the turbine efficiency is improved by maintaining the turbulence in the gas in the height direction of the blades as it flows onto said blades to thereby reduce the flow loss and increase turbine efficiency.

Yet another preferred embodiment of this invention is characterized by forming a corrugated surface on the side walls of the foregoing scroll. This invention, by means of forming a corrugated surface on the side walls of the scroll, compared to that of the smooth surface in the prior art , causes a velocity reduction of the radial direction velocity ($C_R$) due to the corrugated surface on both side walls of the scroll, in the areas that correspond to the square areas at both ends of the turbine blades (i.e. on the shroud side and hub side), which in turn causes the radial direction velocity ($C_R$) distribution to become more uniform in the direction of the axis of rotation of said scroll.

This inhibits the development of a three dimensional boundary layer, and the gas flow in the height direction of the turbine blades remains distorted as it flows onto said blades to thereby reduce the flow loss and increase turbine efficiency.

Yet another preferred embodiment of this invention is characterized by forming the foregoing scroll in a manner such that, in a turbine scroll used in a radial turbine in which the operating gas flows through a vortex-shaped scroll formed inside the turbine casing to the blades of the turbine rotor positioned inside said turbine scroll, flowing into said blades in the radial direction to rotate the turbine rotor before flowing out, in the axial direction, it is characterized by the configuration wherein the sectional area of the tongue's downstream formed at the inner circumference of the gas inlet is smaller than the sectional area of the tongue edge by narrowing in the width direction in an amount corresponding to the thickness (T) dimension of the tongue.

Preferably, the width of the tongue's downstream side walls is formed partially narrower in an amount equal to the thickness (T) of said tongue than the width of the tongue edge.

According to this embodiment, by forming the scroll to make the sectional area of the flow path at the downstream right after the tongue smaller than the sectional area of the flow path at the tongue's edge (especially, by making the width dimension between the walls at the downstream right after the tongue smaller by an amount corresponding to the thickness (T) of the tongue than the walls at the tongue edge, it is possible to reduce the wake generated by the tongue and to reduce the turbulence at the outlet of the scroll.

Further, reducing the width direction of the flow path at the downstream right after the tongue by an amount corresponding to the thickness (T) of the tongue, inhibits the development of a three dimensional boundary layer, and as was the case with the preferred embodiments mentioned above, the flow loss caused by the gas flow which remains distorted in the height direction of the turbine blades as it flows onto said blades can be reduced, and the turbine efficiency can be thereby increased.

To achieve the second objects mentioned above improving the shape of the blades, a preferred embodiment of the invention is related to a structure of turbine blades used in a radial turbine in which the operating gas flows through a vortex-shaped scroll formed inside the turbine casing to the turbine blades of the turbine rotor positioned inside said turbine scroll, flowing into said blades in the radial direction to rotate the turbine rotor before flowing out, in the axial direction. It is characterized by the configuration in which the turbine blades have cut-away areas at the blade corners by a prescribed amount, which are provided on the inlet edge at the shroud side and hub side where the operating gas flows.

The foregoing cut-away area can be a curve shaped cut-away which has a rounded sectional shape, or the foregoing cut-away area can have a linear sectional shape.

According to this configuration, the cut-away areas have been established on the shroud side and hub side of the inlet edge surface of the turbine blades, which makes the diameter of both ends of the foregoing inlet edge surface to be smaller than the diameter in the center. Accordingly, the amount that is cut away to form the foregoing cut-away areas can be varied to adjust to the gas flow distribution at the inlet to the turbine blades at the two ends of the inlet edge surface, i.e. relieved toward the inside circumference at the shroud side and the hub side, as a means to adjust to, the optimal angle in the height direction of the turbine blades for the relative inflow angle ($\beta$) of the gas into the turbine blades.

Thus, according to the present embodiment, the gas impact angle (incidence angle) at the inlet to the turbine blades can be kept constant in the height direction of the blades, which avoids the issues in the conventional technology where there was impact loss and development of secondary flows inside the turbine blades due to the non-uniform relative gas inflow angles; such losses decreased the efficiency of turbines.

In addition, as described above, a three dimensional boundary layer forms with a width of about 10% to 20% the height of said inlet edge near the inlet edge surface of the turbine blades, and this three dimensional boundary layer causes the non-uniformity in the relative inflow angles in the height direction at the inlet to the turbine blades. However, as described above, by cutting away the foregoing inlet edge surface to at least match the width over which the three dimensional boundary layer is generated, that is, making the length in the radial direction of the cut-away area 10% to 20% of the height of the foregoing inlet edge surface, it is possible to eliminate the non-uniformity in the relative gas inflow angles between the center and the ends (shroud side and hub side) of the turbine blade inlet, to keep the gas incidence angle constant in the height direction of the inlet of the turbine blades.

BRIEF DESCRIPTION OF THE DRAWINGS

FIG. 6(A), Figure (B), Figure (C) are the diagrams to explain the operation of the foregoing fourth embodiment.

FIG. 13(A) is a front view from a right angle to the axis of rotation, and FIG. 13(B) is a view in the direction of the arrows on line B—B of FIG. 13(A).

FIG. 16(A) shows a blade according to the prior art, and FIG. 16(B) shows circumferential directional component CO of the absolute velocity C of the gas at the inlet to the blades.

DETAILED DESCRIPTION OF THE PREFERRED EMBODIMENTS

In this section we shall explain several preferred embodiments of this invention with reference to the appended drawings. Whenever the size, materials, shapes, relative positions and other aspects of the parts described in the embodiments are not clearly defined, the scope of the invention is not limited only to the parts shown, which are meant merely for the purpose of illustration.

Structure of the Scroll

Figure 11:
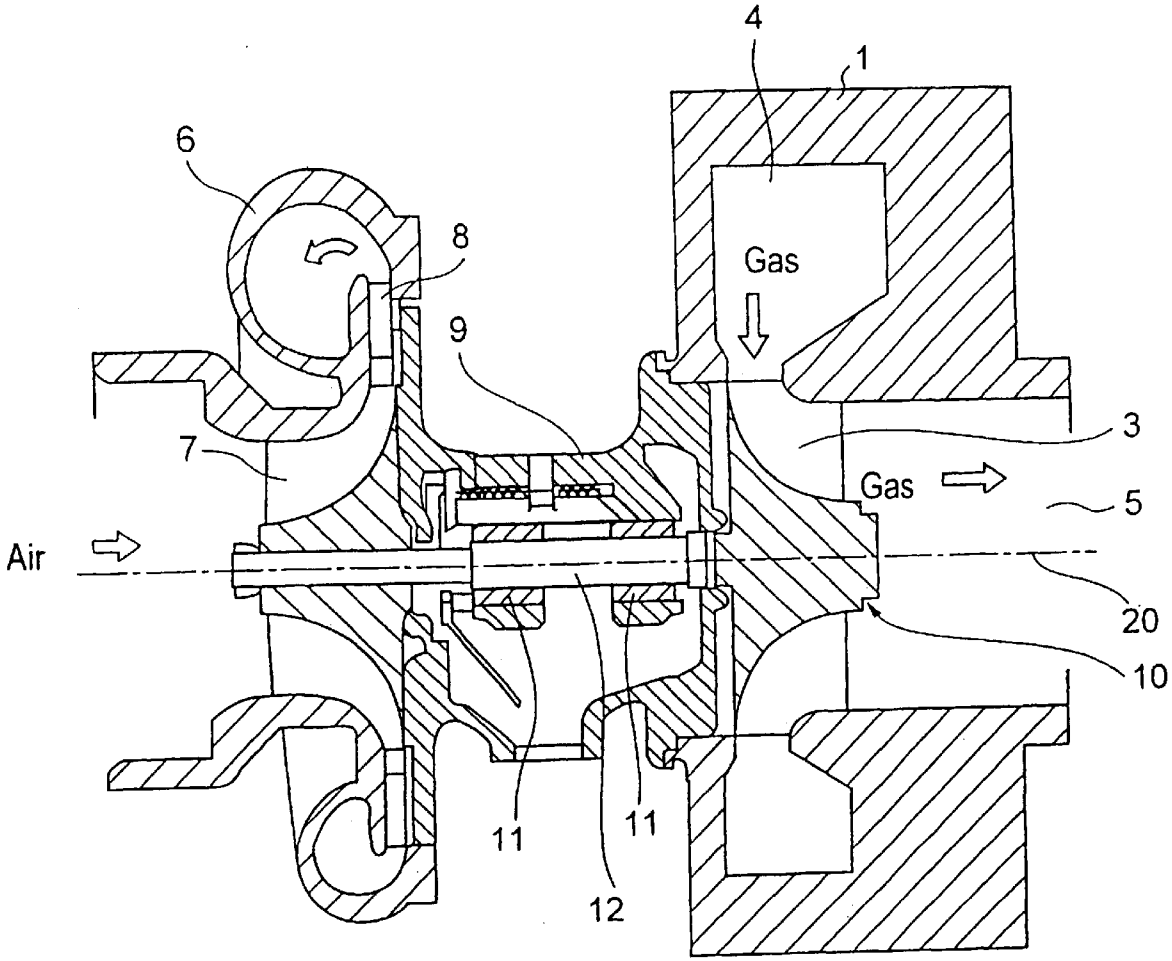
FIG. 11 Prior Art
FIG. 11 shows an example of a turbocharger using a radial turbine according to the prior art.
Figure 12:
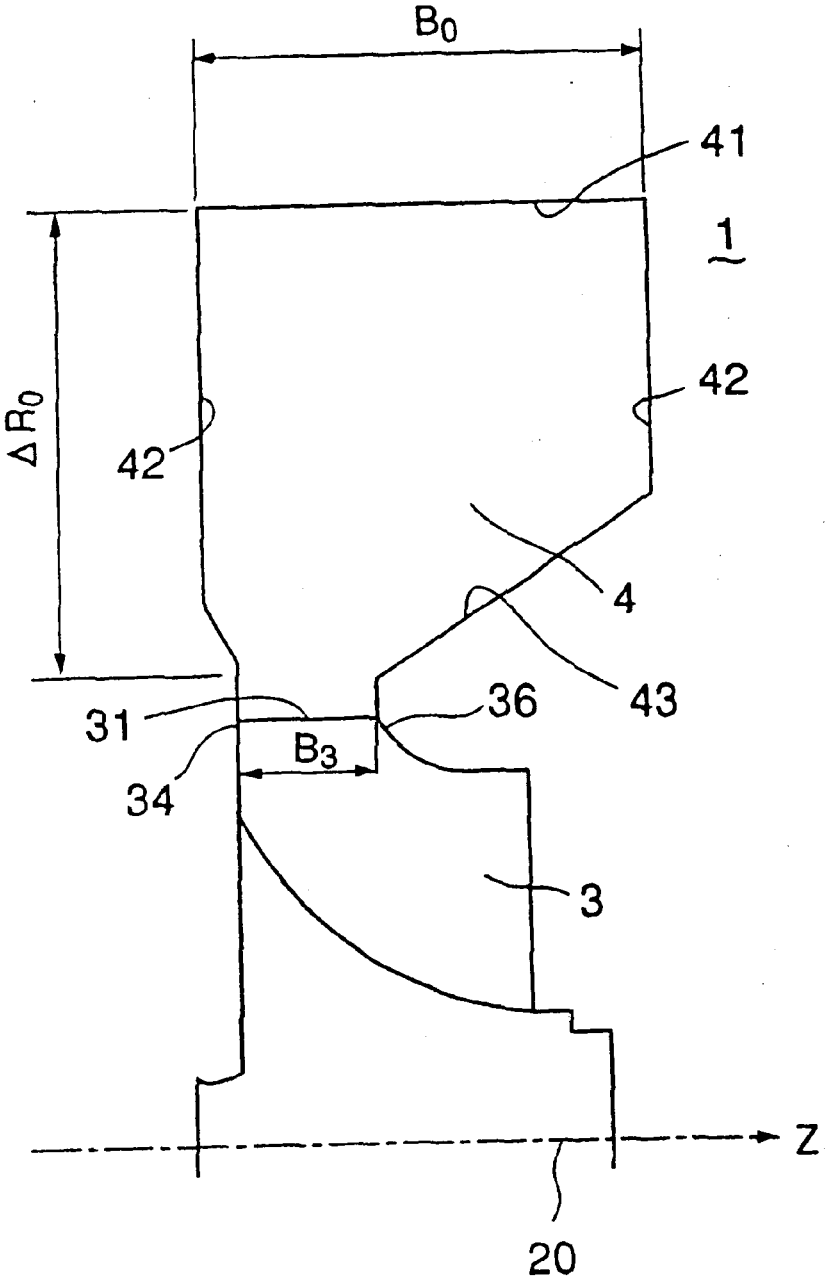
FIG. 12 Prior Art
FIG. 12 is a structural diagram showing the foregoing scroll 4 and surrounding area in a radial turbine according to the prior art.
Figure 13B:
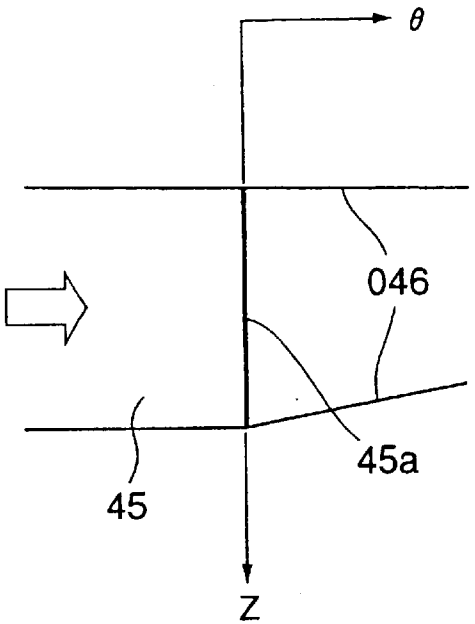
FIG. 13(A), FIG. 13(B) show the area around a tongue formed in inner circumference of the gas inlet to the radial turbine.
Figure 13A:
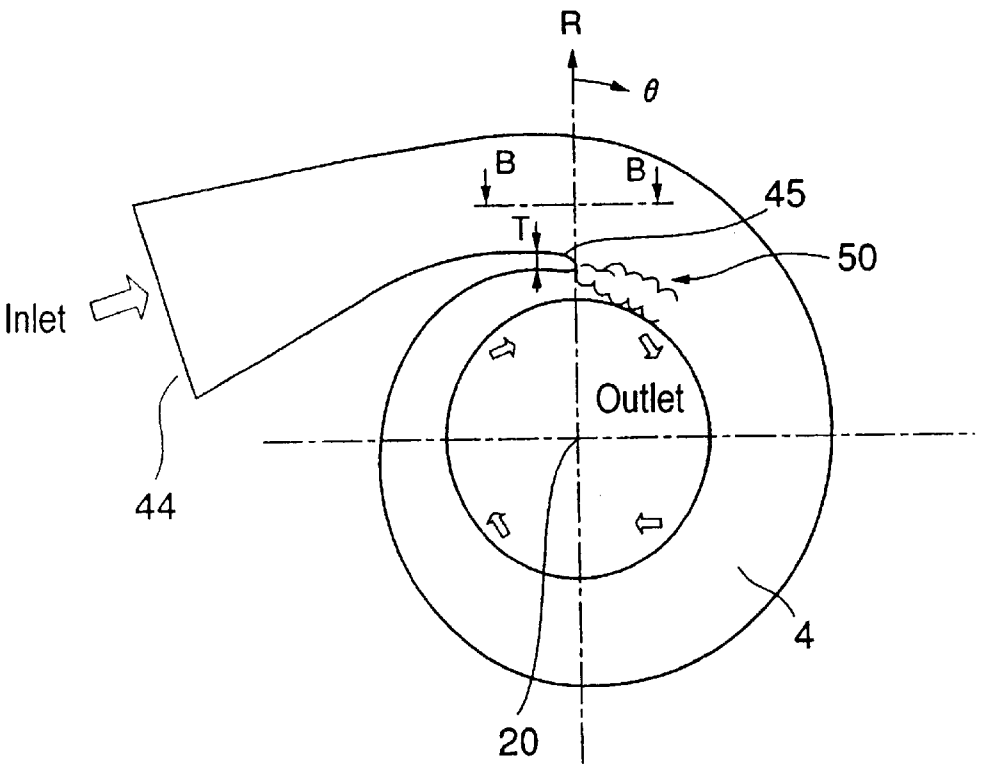
Figure 14:
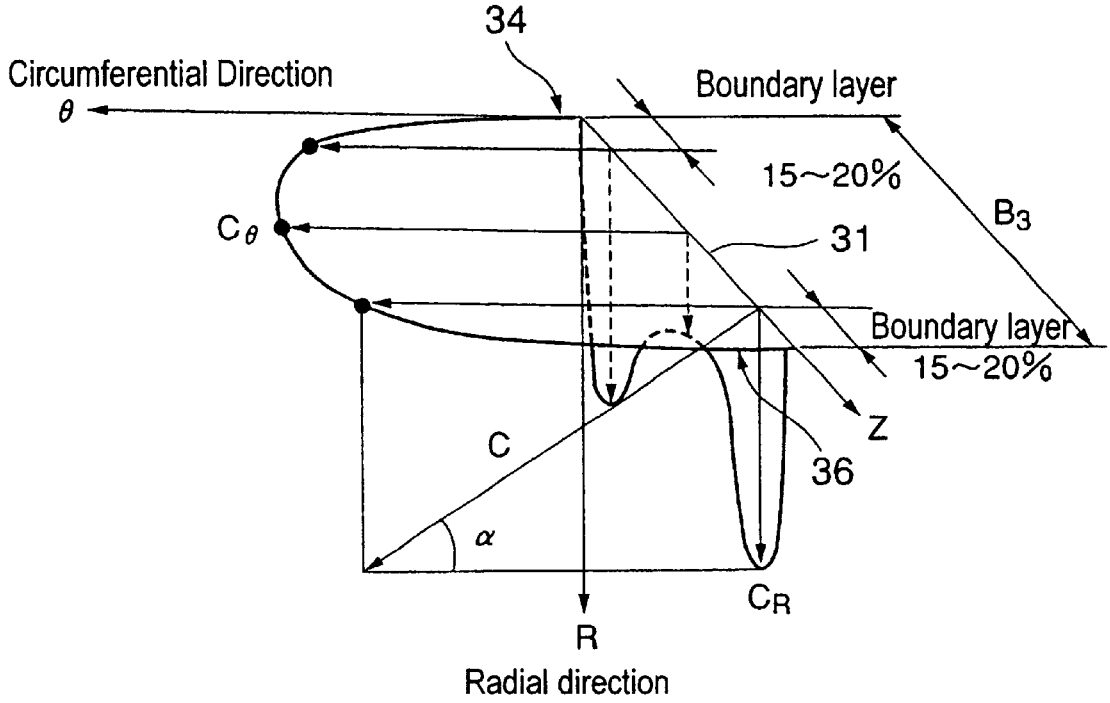
FIG. 14 show the operational sketch showing the foregoing gas inflow velocity C.
Figure 15A:
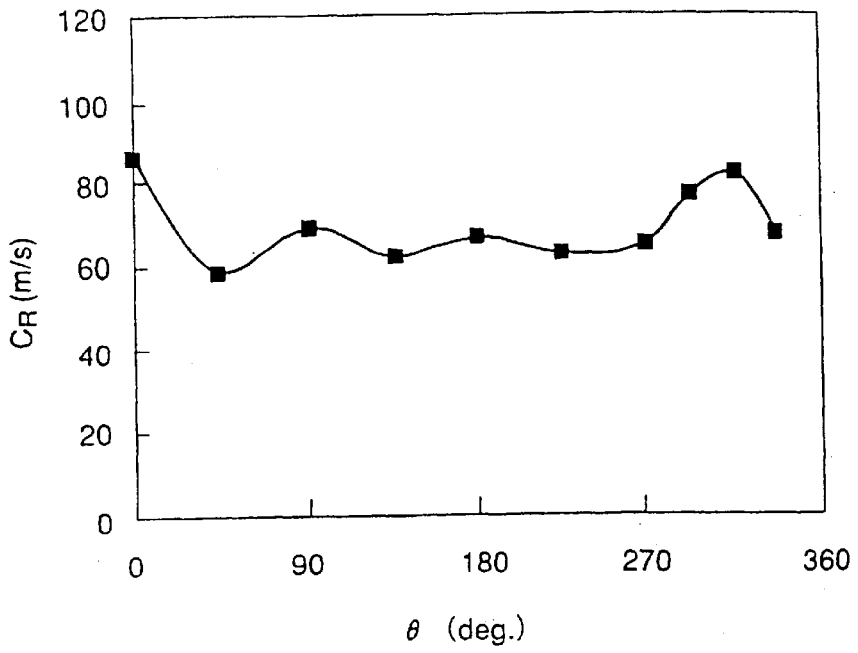
FIG. 15(A) Prior Art
FIG. 15(A) and FIG. 15(B) show a velocity distribution according to the prior art.
Figure 15B:
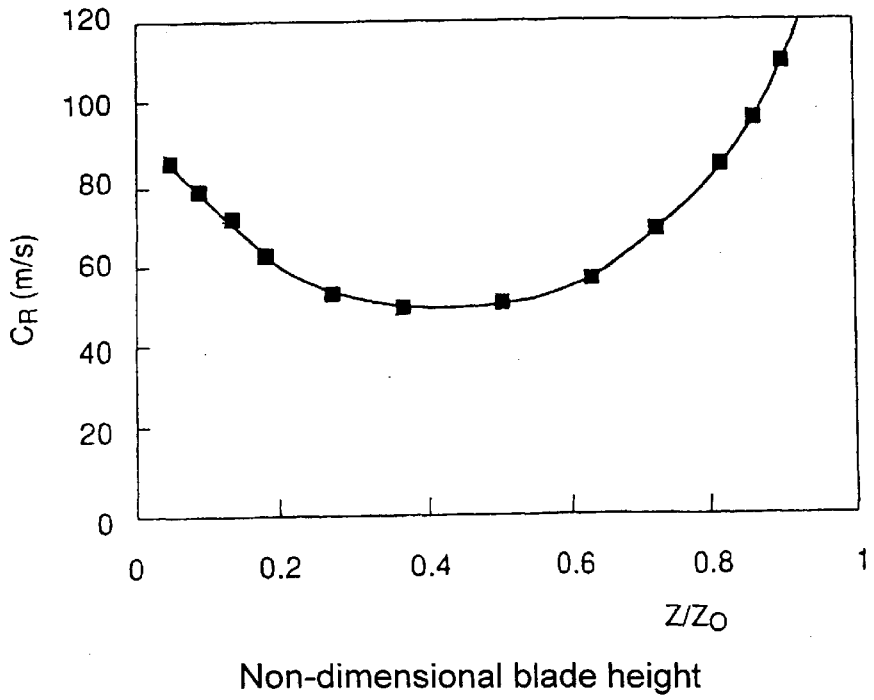
FIG. 15(B) Prior Art
Figure 17A:
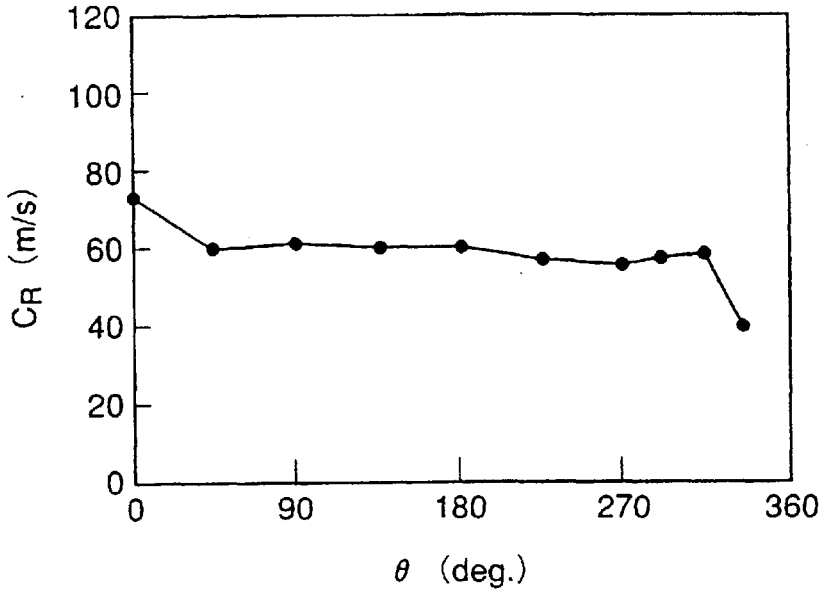
FIG. 17(A) and FIG. 17(B) are the explanatory diagram of the changes in the gas flow velocity in the circumferential and height direction.
Figure 17B:
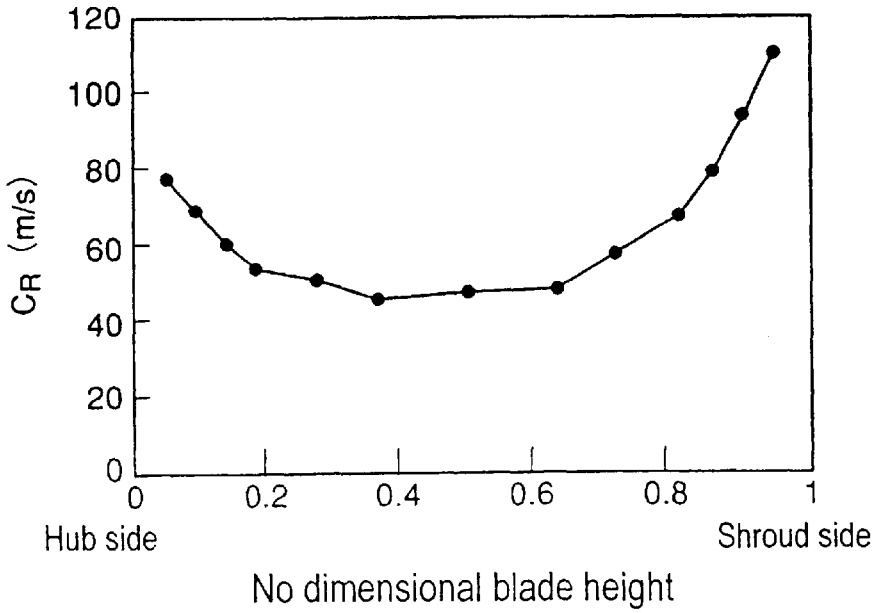

The basic structure for the turbocharger with the radial turbine is similar to that of conventional turbochargers shown in FIG. 11. However, this invention has improved the shape of the scroll.

In FIG. 11, which shows the overall structure of a turbocharger that incorporates a radial turbine, 1 represents the turbine casing, 4 the vortex-shaped scroll formed inside said turbine casing 1, 5 the gas outlet flow path formed inside the foregoing turbine casing 1, 6 the compressor casing, and 9 the bearing housing which joins the foregoing turbine casing 1 with compressor casing 6.

10 is the turbine rotor which has a plurality of turbine blades 3 attached at equal intervals around its circumference. 7 is the compressor; 8 the diffuser, which is mounted at the air outlet of said compressor 7; and 12 the rotor shaft, which joins turbine rotor 10 with compressor 7. 11 is a pair of bearings affixed in bearing housing 9 to support the forgoing rotor shaft 12. 20 represents the axis of rotation for the foregoing turbine rotor 10, compressor 7 and rotor shaft 12.

In the turbocharger equipped with this radial turbine, exhaust gases from the internal combustion engine (not shown) enter the foregoing scroll 4, where they are swirled along scroll 4 and flow into said turbine blades 3, from the outside circumferential edge surface of the inlet to the turbine blades, toward the center of turbine rotor 10 in the radial direction, and after performing the expansion work on said turbine rotor 10, flow out in the axial direction through the gas outlet passage 5.

Figure 1:
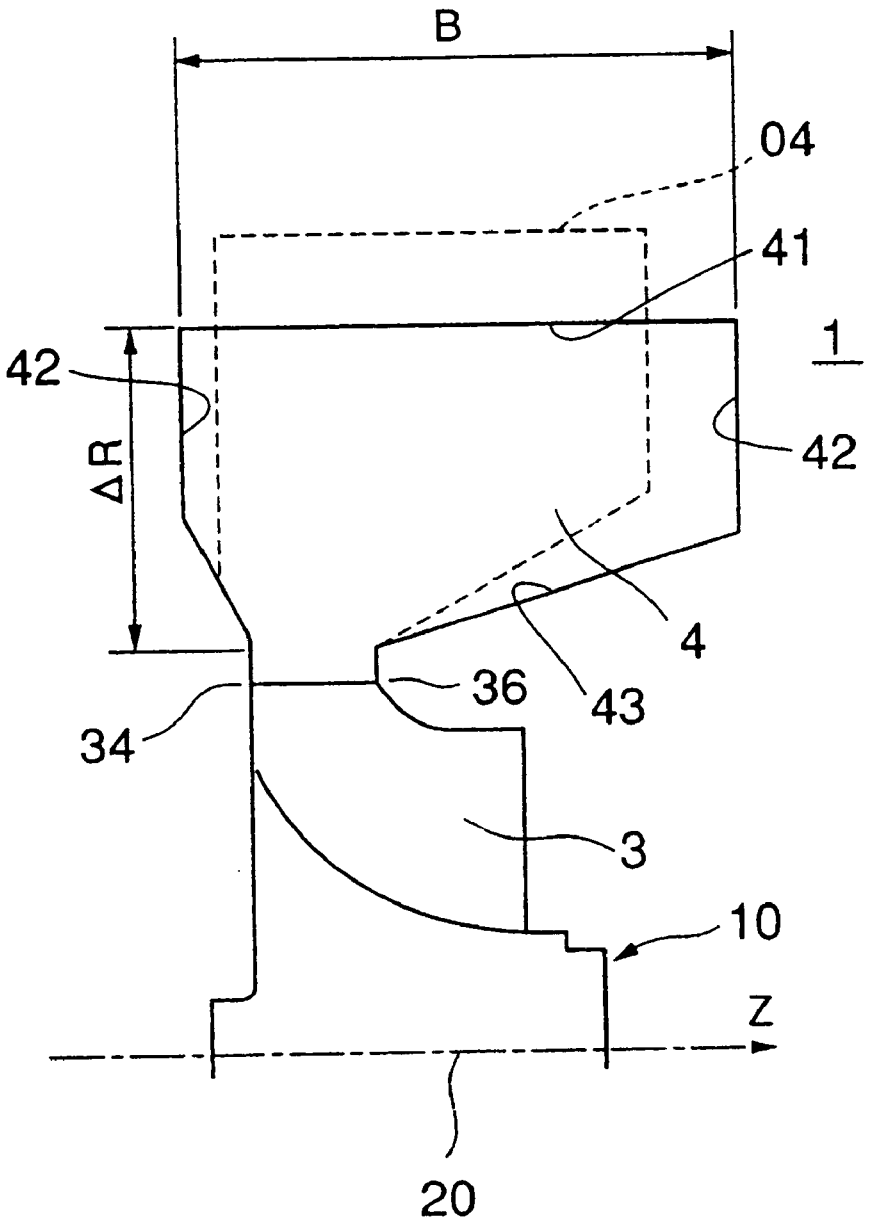
FIG. 1 is a sectional structural diagram of the upper half of a first embodiment from the axis of rotation of the turbine rotor and scroll.

According to the first embodiment of this invention for the scroll shown in FIG. 1, a plurality of turbine blades 3 are affixed at equal intervals around the outside circumference of turbine rotor 10.

4 represents the scroll formed inside of turbine casing 1, 41 is its outer circumferential wall, 42 is its front and back side walls, and 43 is its inner circumferential wall. The foregoing scroll 4 has been formed in a manner such that the distance between its front and back side walls 42, in other words, the width B along the axis of rotation, is greater than the width ΔR in the radial direction between the outer circumferential wall 41 and the inner circumferential wall 43.

Thus, the forgoing scroll 4 is formed in a manner such that the scroll width ratio, between foregoing radial direction width (ΔR) and the width (B) along the axis of rotation 20, ΔR/B is: ΔR/B=0.3 to 0.7, preferably ΔR/B=0.5.

Thus, in this embodiment, the shape of the scroll has been flattened by making width ΔR in the radial direction of scroll 4, and the width B in the direction of the axis of rotation 20 to achieve scroll width ratio ΔR/B=0.3 to 0.7, which means that the width B of scroll 4 in the direction of the axis of rotation is longer, roughly double, than the width ΔR in the radial direction.

Although the total friction loss in this embodiment, from side walls 42 and inner and outer circumferential walls 43, 41, is approximately the same as for conventional designs having a scroll width ratio of ΔR/B=1, the radial direction velocity $C_R$ at the square areas on both ends of turbine blades 3, which corresponds to shroud side 36 and hub side 34 by both side walls 42, 42 of said scroll 4, has been reduced compared to conventional designs, which causes the distribution of the radial direction velocity $C_R$ in the direction of the axis of rotation 20 to become more uniform. This results in a reduction of secondary flow loss inside the scroll.

Figure 2:
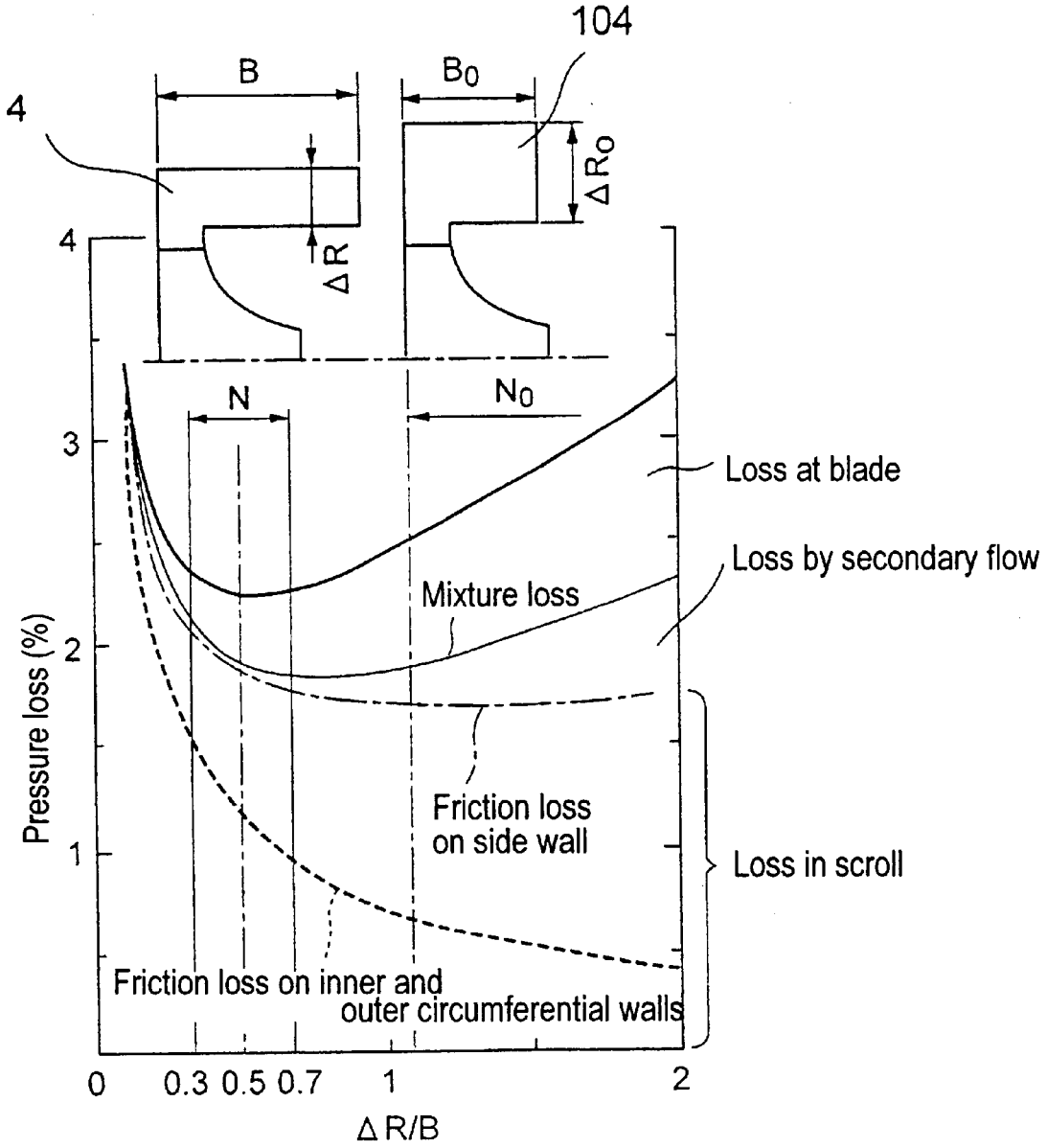
FIG. 2 is a graph that explains the operation of the foregoing first embodiment.

FIG. 2 shows the results of a simulation of flow loss in scroll 4 and at turbine blades 3 (the relationship between the foregoing scroll width ratio ΔR/B and pressure loss). As is apparent from FIG. 2, when the scroll is structured according to the present invention (the range designated by N) where ΔR/B=0.3 to 0.7, preferably 0.5, the gas flow loss is dramatically lower than the conventional design for the scroll width ratio ΔR/B=1, shown in the $N_0$ range.

Accordingly, the development of a three dimensional boundary layer was inhibited, and the flow loss passing through scroll 4, caused by the gas flow which remains distorted in the height direction of the turbine blades 3 as it flows onto said blades 3 can be reduced. Especially mixture loss can be reduced.

Figure 3B:
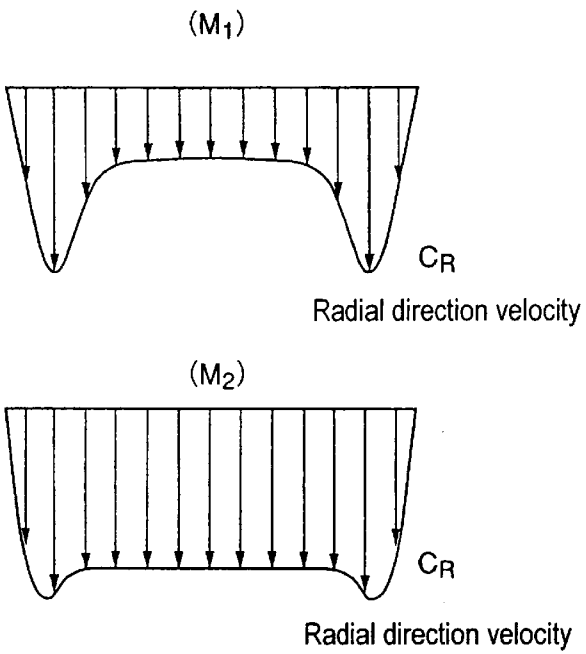
FIG. 3(B) shows the velocity distribution of the gas flow.
Figure 3A:
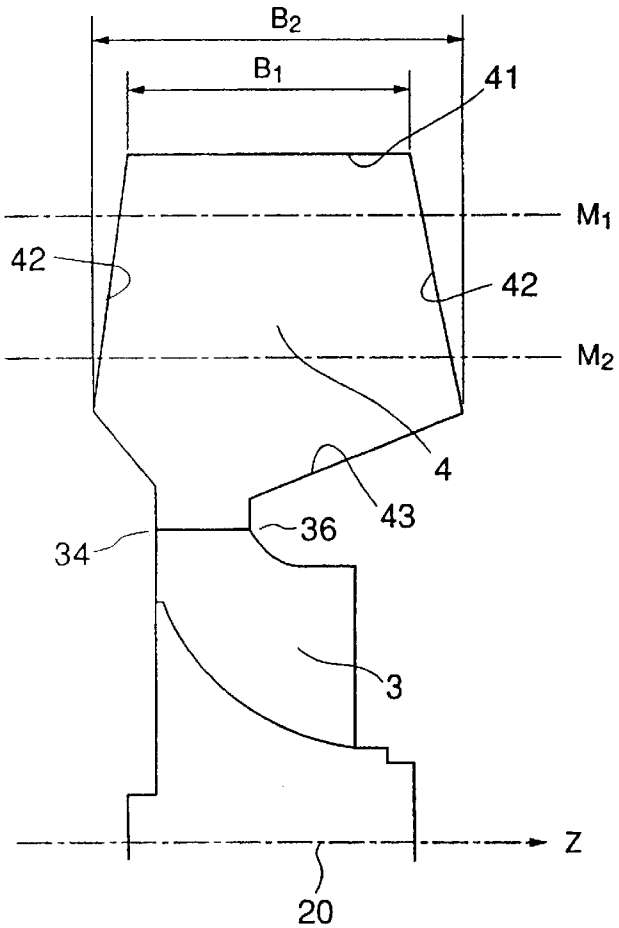
FIG. 3(A) shows a second embodiment corresponding to FIG. 1.

FIGS. 3(A), and (B) show a second embodiment of a scroll. As shown in FIG. 3(A) the sectional shape of scroll 4 has been formed to expand at a fixed rate in a manner such that width B in the direction of axis of rotation 20 expands either in a straight line or curve (this example shows a linear expansion) from width $B_1$ on the outside circumferential side in the radial direction to width $B_2$.

The foregoing width B in the direction of the axis of rotation is formed in a manner such that the width $B_2$ on the inside circumferential side in the radial direction is 1.2 to 1.5 times the width $B_1$ on the outside circumferential side. The remainder of the structure is the same as shown for the first embodiment in FIG. 1, as are the reference numbers for corresponding parts.

In this embodiment, since the width B in the direction of the axis of rotation 20 in the scroll is structured to expand in the radial direction from the outside circumferential wall 41 side to the inner circumferential wall 43 side, the radial direction velocity $C_R$ at the side walls 42, corresponding square areas on both ends of turbine blades 3, i.e. the shroud side 36 and the hub side 34, is reduced compared to conventional designs having a fixed scroll width, which causes the distribution of the radial direction velocity ($C_R$) in the direction of the axis of rotation to be more uniform.

To wit, as shown in FIG. 3(B), while the distribution in the direction of the axis of rotation of the radial direction velocity ($C_R$) is disparate between the center and the side wall 42 areas for the $M_1$ area of scroll 4 on the outside circumferential side wherein the velocity near the side walls 42 is greater than the velocity near the center and becomes uneven, in the inside circumferential side in the $M_2$ area near turbine blades 3, the distribution of the velocity is more uniform due to the reduction in the radial direction velocity $C_R$ near the side walls in the direction of the axis of rotation.

This results in the inhibition of the development of a three dimensional boundary layer, and in the reduction of the flow loss at the blades due to the gas flow entering said turbine blades with the turbulence intact in the height direction of the blades.

Figure 4B:
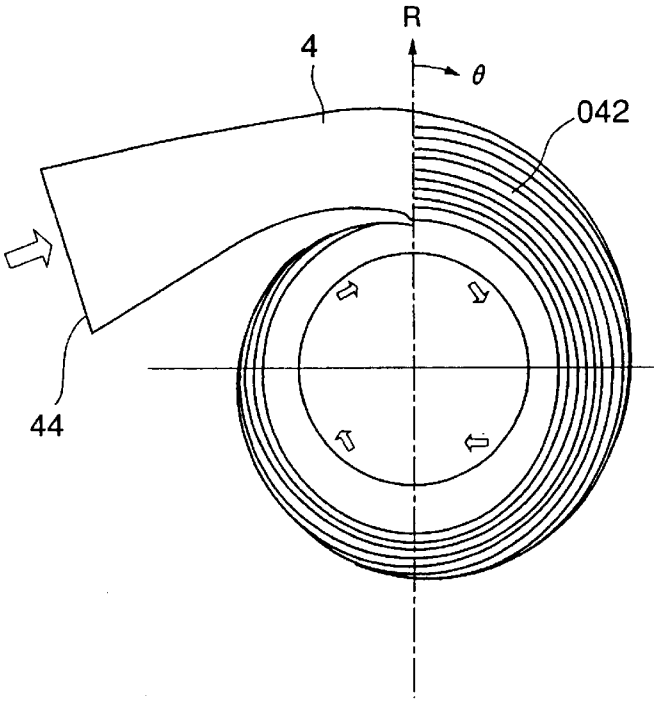
FIG. 4(B) is a perspective view taken along the arrows A—A of FIG. 4(A).
Figure 4A:
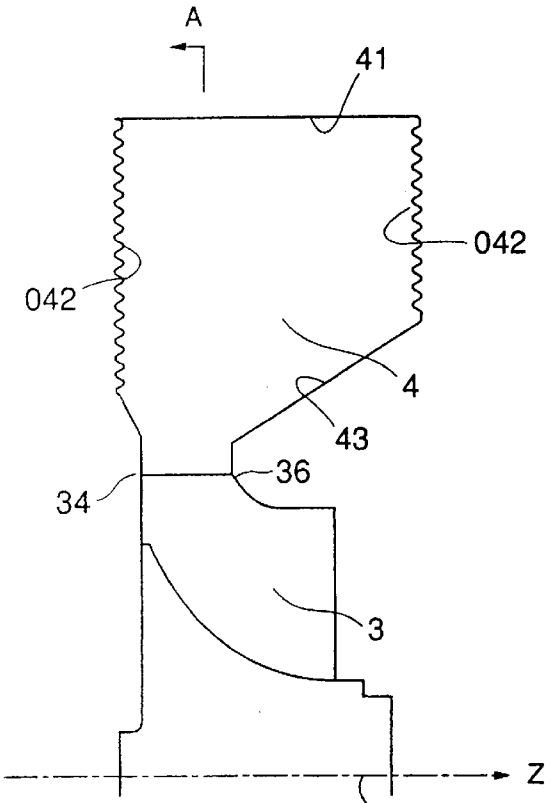
FIG. 4(A) shows a third embodiment corresponding to FIG. 1.

FIGS. 4(A), (B) show a third embodiment of a scroll wherein both side walls 042 of the foregoing scroll 4 have been formed with a corrugated surface. As shown in FIG. 4(B), whether a concentric plurality of grooves be formed in the radial direction or whether spiral grooves be formed, the convex/concave surfaces need only to achieve the effect of reducing the radial direction velocity $C_R$, as elaborated below. The remainder of the structure is similar to that of the first embodiment depicted in FIG. 1, and the reference numbers for corresponding parts are identical.

The corrugation of the surface of both side walls 042 of scroll 4 in the present embodiment serves to reduce the radial direction velocity $C_R$ in the area of both side walls 042 of said scroll 4, in other words, at both ends of the turbine blades 3 at the shroud side 36 and hub side 34, compared to the structure of the prior art that employed smooth sides. This results in a more uniform distribution of the radial direction velocity $C_R$ in the direction of the axis of rotation of said scroll 4.

This results in the inhibition of the development of a three dimensional boundary layer, and in the reduction of the flow loss at the blades due to the gas flow entering said turbine blades with the turbulence intact in the height direction of the blades.

Figure 5A:
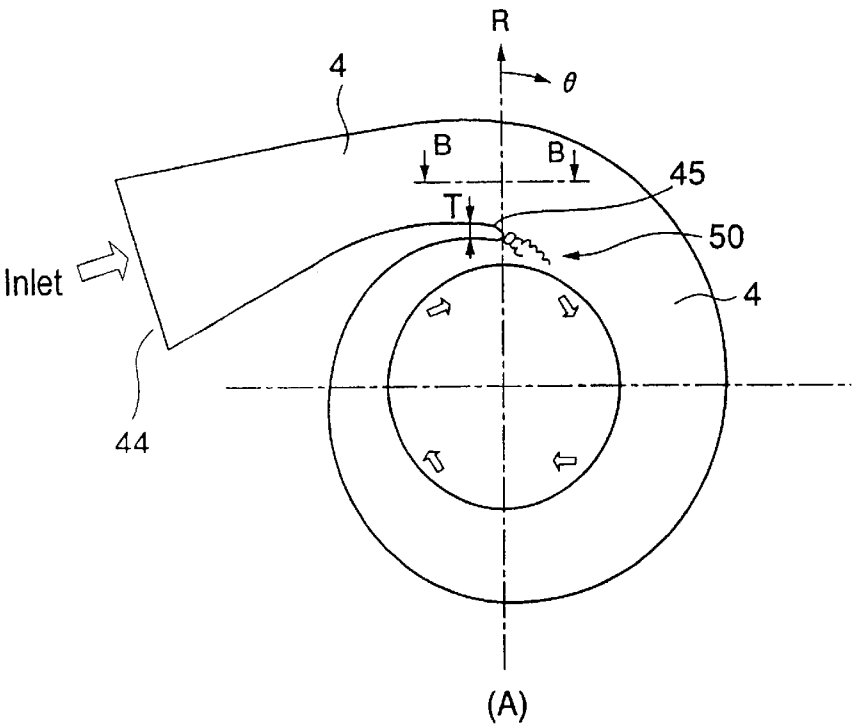
FIG. 5(A) shows a fourth embodiment being a front view of the scroll.
Figure 5B:
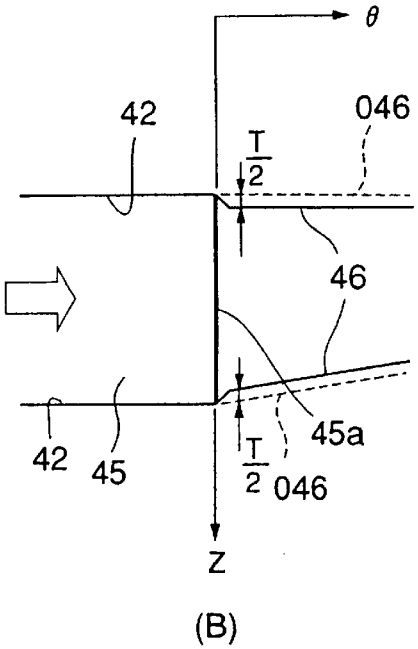
FIG. 5(B) is a perspective view taken along the arrows B—B of FIG. 5(A).

FIGS. 5(A), (B) show a fourth embodiment of a scroll, wherein the width dimension between side walls 46 at the downstream right after the tongue 45 which was formed to a thickness of T on the inside circumference of the gas inlet has been narrower by an amount equal to the thickness (T) of the tongue to produce a sectional area of the flow path at the downstream right after the foregoing tongue 45 that is slightly smaller than the sectional area of the flow path at the tongue edge 45*a*. Thus, the constriction of the flow path at the downstream right by the tongue edge 45*a* of the tongue reduces the wake that forms at the tongue, and thereby, reduces the distortion in the flow at the outlet of scroll 4.

When the gas flows through the scroll 4, wake 50 is generated due to the pressure difference between the upper space and the lower space at the tongue 45. According to the fourth preferred embodiment, the width of the side wall 46 has been formed partially reduced by an amount equal to the thickness (T) of the tongue, to produce a sectional area of the flow path at the downstream right after the foregoing tongue 45 that is slightly smaller than the sectional area of the flow path at the tongue edge 45*a*. Thus, the constriction of the flow path at the downstream right after the tongue edge 45*a* of the tongue reduces the wake 50 that forms at the tongue, and thereby, reduces the distortion in the flow at the outlet of scroll 4.

Also, in this embodiment, as shown in FIG. 6(C), due to the action of the slight constriction of the width of the flow path at the downstream right after the tongue edge 45*a*, the tendency toward the formation of a boundary layer at the position ($L_1$) of tongue 45 reduces the circumferential velocity Co near the side walls 42, while the distribution of the circumferential velocity in the direction of the rotational axis 20 of scroll 4 becomes less uniform. On the other hand, at position ($L_2$) of the side walls 46 of the downstream right after the tongue, the reduction of the aforementioned circumferential velocity $C_\theta$near the side walls 42 is avoided, and the distribution of the circumferential component becomes more uniform. Accordingly, the distribution of the radial direction velocity $C_R$ in the direction of axis of rotation 20 is made more uniform to inhibit the development of a three dimensional boundary layer, while the gas flow loss caused by the gas flow which remains distorted in the height direction of the turbine blades as it flow onto said blades can be reduced.

Figure 7A:
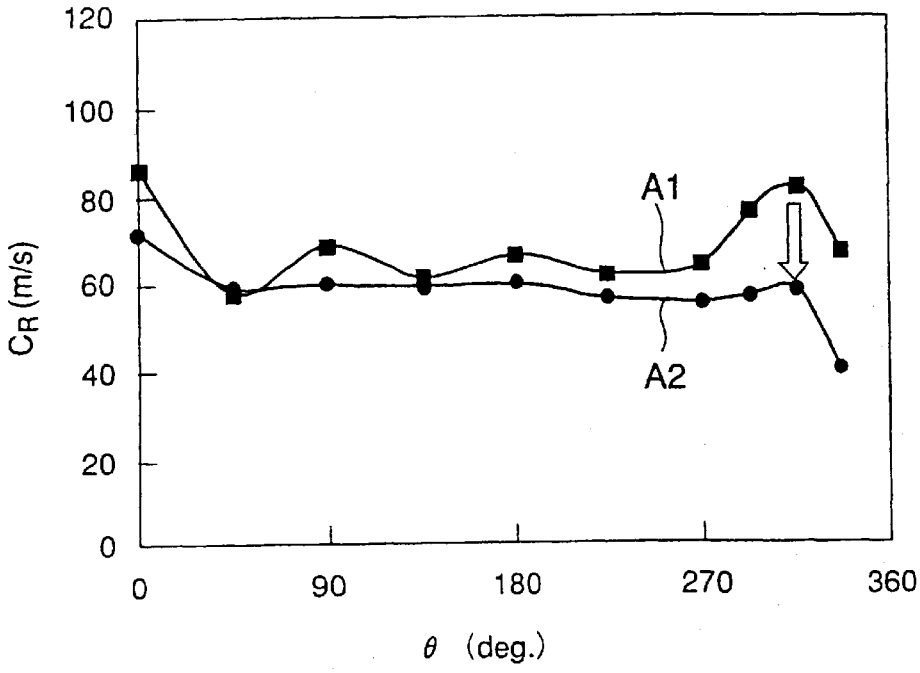
FIG. 7(A) and Figure (B) show a graph that shows the velocity distribution of the gas flow inside the scroll.
Figure 7B:
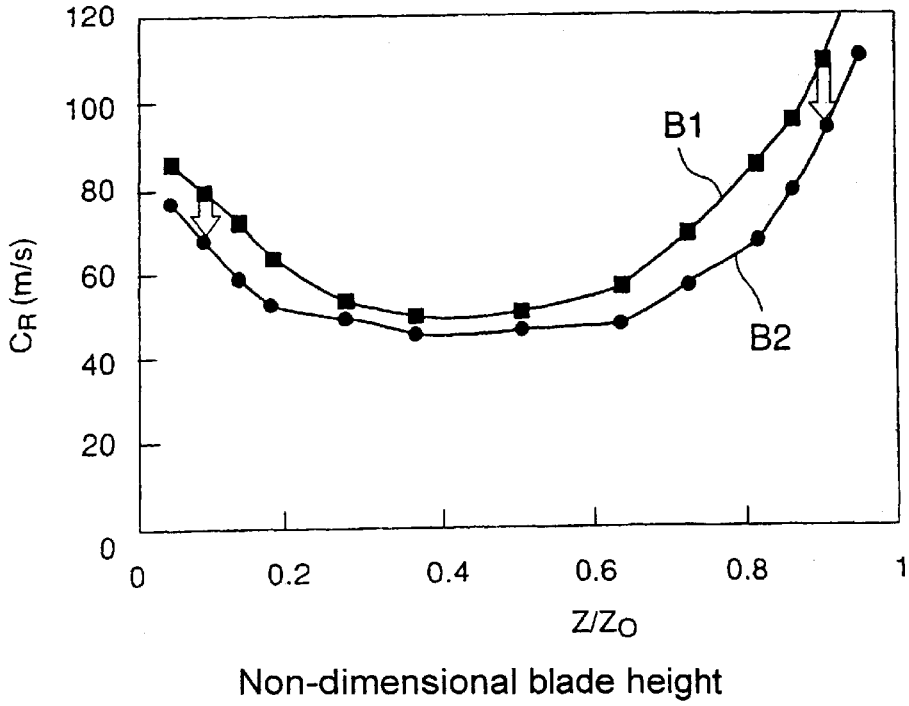

FIGS. 7(A), and 7(B) show the graphs explaining the distribution of the radial direction velocity $C_R$ for the first through fourth embodiments of this invention, and for a conventional scroll. FIG. 7(A) shows the distribution in the circumferential direction (θ), and FIG. 7(B) shows the distribution in the height direction (Z) of the turbine blades. As is apparent from FIGS. 7(A) and 7(B), the distribution in the circumferential direction (θ) of the radial direction velocity ($C_R$) of the fourth embodiment has been made more uniform by the scroll of the present invention ($A_2$) as compared with conventional scrolls ($A_1$). In addition, the distribution in the height direction (Z) of the turbine blades for the radial direction velocity ($C_R$) is also more uniform in the foregoing embodiments ($B_2$) than for the conventional scroll ($B_1$).

Structure of the Blades

The present invention improves the gas inlet area of the turbine blades used in the turbocharger employing a radial turbine which is basically similar to the conventional structure already shown in FIG. 11.

Figure 8A:
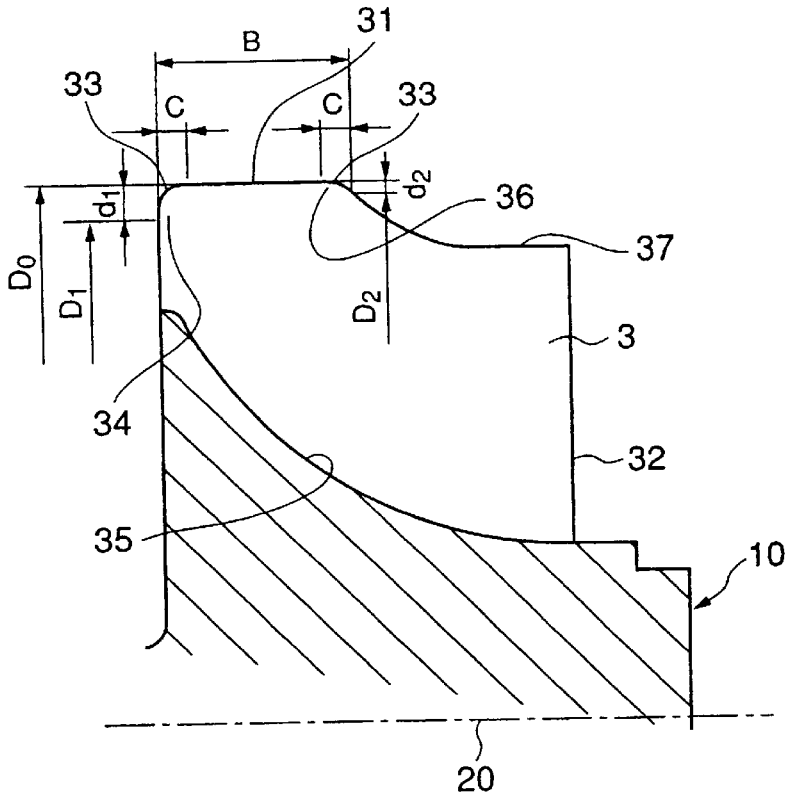
FIG. 8(A) is a sectional view taken along the axis of rotation of a turbocharger that incorporates the present inventions in a radial turbine.
Figure 8B:
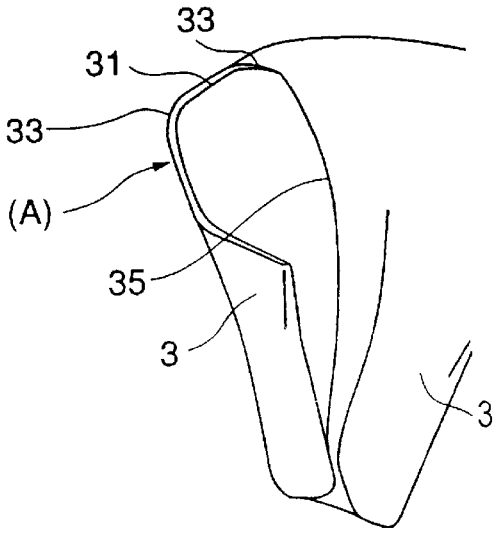
FIG. 8(B) is a rough sketch of the same.

To wit, as shown in FIG. 8(A) and FIG. 8(B) showing the turbine blades according to the fifth embodiment of this invention, a plurality of turbine blades 3 have been affixed at uniform intervals around the circumference of turbine rotor 10. Said turbine blades 3 are structured as follows.

31 is an inlet edge surface for the gas inlet, 35 the hub, 37 the shroud, and 32 the outlet edge surface. The foregoing inlet edge surface 31 is has a flat surface formed in the center, and on the two ends in the height direction, on shroud side 36 and hub side 34, there is an angled cut-away area 33 that has been cut by a prescribed amount. FIG. 8(B) shows a perspective view of the foregoing cut-away area 33.

The sectional shape of said cut-away area 33 is rounded to a curved shape to make a smooth transition on the flat inlet edge surface 31, he shroud 37 and hub 35 sides.

Figure 9:
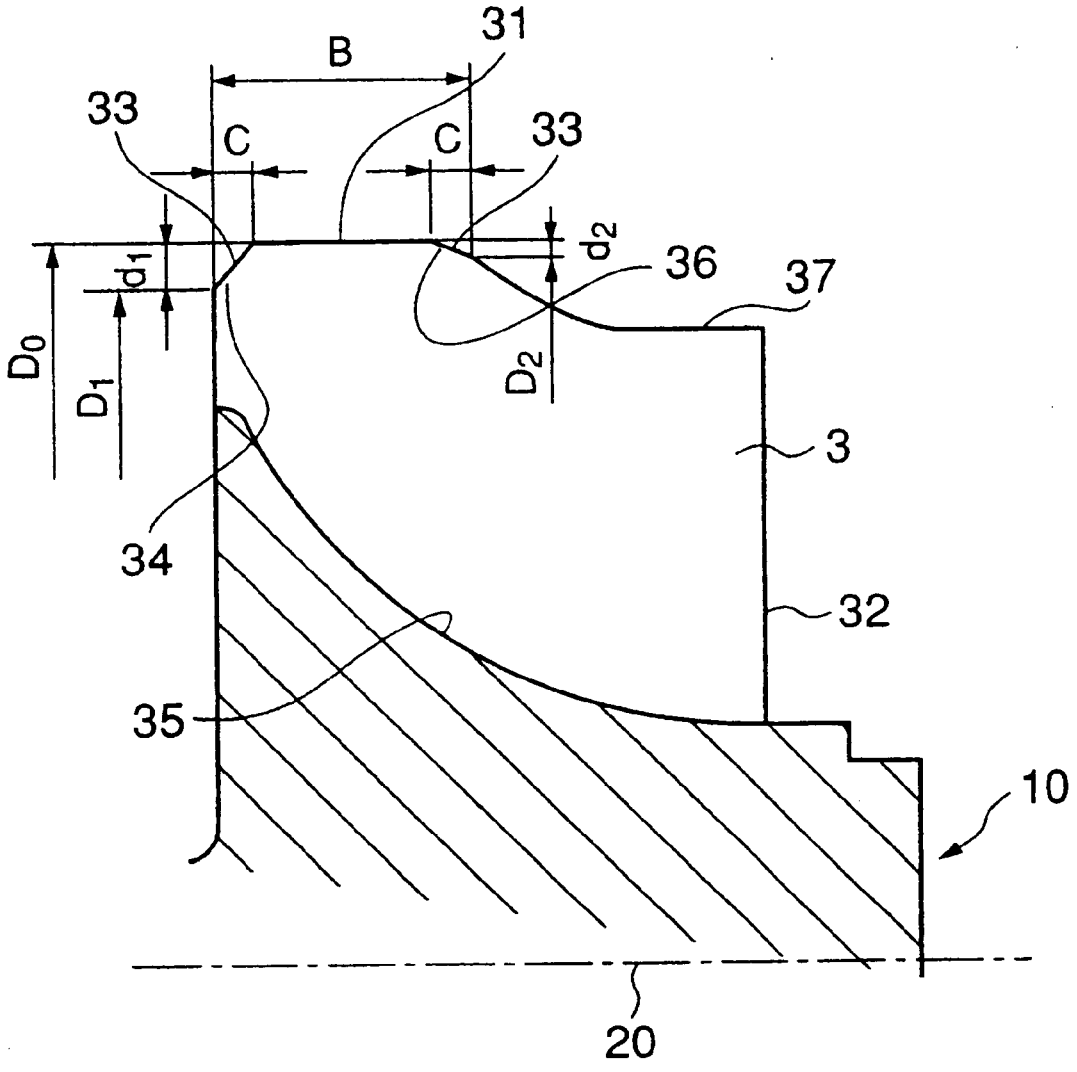
FIG. 9 shows the sectional view showing another example of the present invention.

As shown in FIG. 9 for another example of the turbine blades, the foregoing cut-away area 33 can have a linear sectional shape. The other aspects of the structure are the same as for the above example shown in FIG. 8(A), and these bear the same reference numbers. Since the sectional shape of the cut-away area in this embodiment is linear, it is easy to make the below described adjustments for diameter $D_1$ on hub side 34 and diameter $D_2$ on shroud side 36.

Since the width of the foregoing three dimensional boundary wave that forms at the inlet edge surface 31 is less than 20% of the height B as shown in FIG. 16(B), the amount of the cut-away area 33 in the direction of the height of the turbine blades C, and in the radial direction $d_1$ and $d_2$ shown in FIG. 9 have been structured to be 10% to 20% of the height B of the foregoing inlet edge surface 31 to adjust it to the formation width of said three dimensional boundary layer. $D_0$ is the diameter in the center of the foregoing inlet edge surface 31, $D_1$ the diameter of the cut-away area on hub side 34, and $D_2$ the diameter of the cut-away area on the shroud side 36. The amount of the cut away area 33 is obtained as follows.

In FIG. 16(A), the height of the inlet edge surface 31 has been optimized for the relative gas inflow angle $\beta_1$ to a diameter $D_0$ for the center area of said inlet edge surface 31, but the diameters on the ends, on hub side 34 and shroud side 36, have been recessed by the amounts $d_1$ and $d_2$ to be $D_1$ and $D_2$, respectively.

As shown in FIG. 16(B), the foregoing hub side 34 diameter $D_1$ and shroud side 36 diameter $D_2$, were determined by the relationship between the circumferential directional component $C_0$ of the absolute velocity C of the gas at the inlet to the blades and the circumferential velocity U at the inlet to the turbine blades. To wit, because the foregoing circumferential directional component $C_\theta$speeds up as the diameter of the blade inlet decreases according to the free vortex law ($C_\theta \cdot R$=constant) on the one hand, and the circumferential velocity U decreases ($U=\pi DN/60$ where N is the number of rotations of the turbine rotor) on the other, the foregoing cut-away areas 33, reduce the foregoing diameter $D_1$ on hub side 34 and diameter $D_2$ on shroud side 36, in other words the diameters at the two ends of the inlet edge surface 31 compared to the diameter $D_0$ at the center by the amounts $d_1$ and $d_2$, which increases the circumferential component $C_\theta$of the absolute flow velocity and reduces the circumferential velocity U, to thereby optimize the relative gas inflow angle 2 at the both ends to reduce it to the level of the relative gas inflow angle $\beta_1$ in the center area.

Here, the comparison between the circumferential direction component $C_\theta$of the absolute velocity at the center and on both ends (hub side 34 and shroud side 36) of the inlet edge surface 31 and the radial direction component $C_R$, is already apparent as shown by the triangle of velocity in FIG. 16(A) and FIG. 16(B). The relationship dictates that, by reducing the turbine blade inlet diameters $D_1$ and $D_2$ of the foregoing end areas (hub side 34 and shroud side 36) by 90% to 99% over the diameter $D_0$ in the center, it is possible to optimize the relative gas inflow angle $\beta_2$ at both of the forgoing end areas.

Figure 10A:
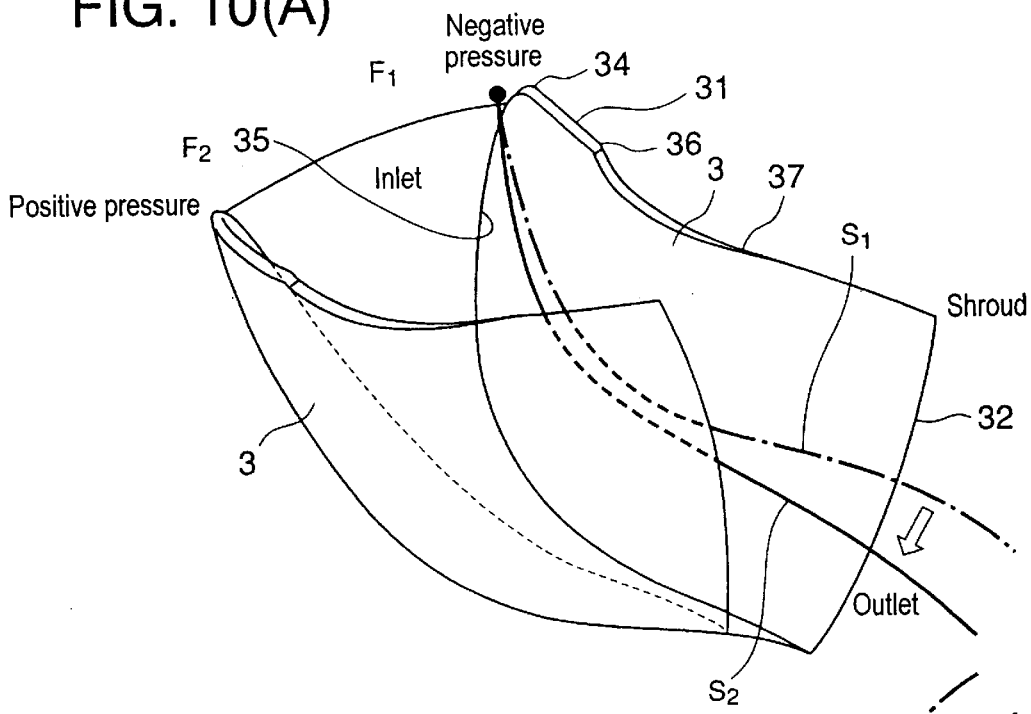
FIG. 10(A) and FIG. 10(B) are the explanatory diagram to show the inhibitory effects upon secondary flows forming inside the turbine blades.
Figure 10B:
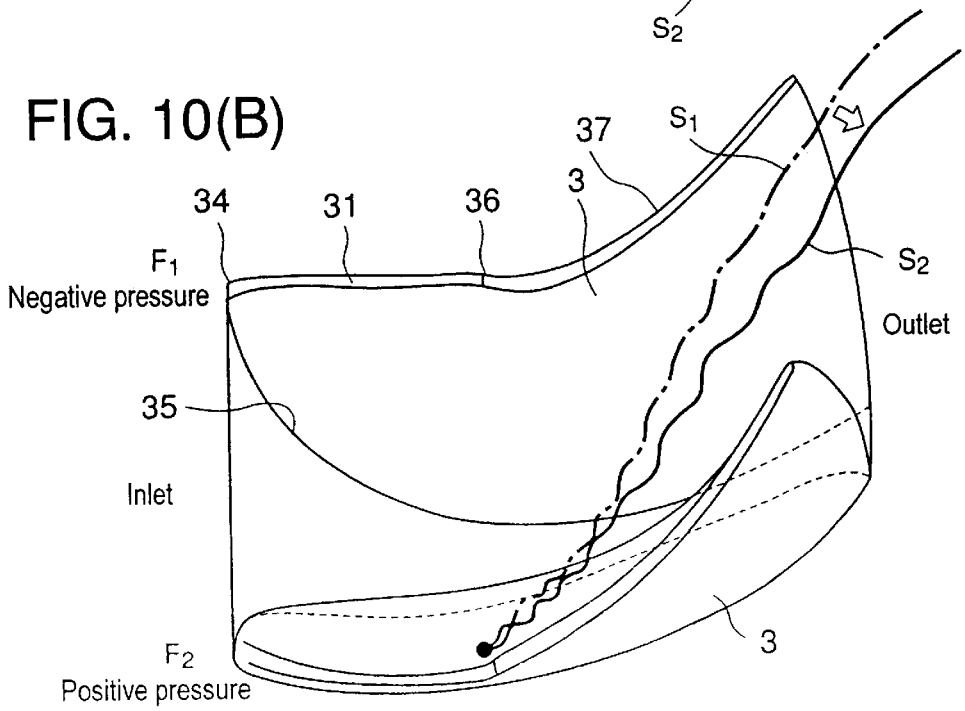

FIG. 10(A) and FIG. 10(B) show the comparison of the secondary flow inside said turbine blades 3 for the turbine blades of this embodiment and conventional turbine blades. The secondary flow is generated in a direction that is perpendicular to the primary flow. In the Figures, $S_1$ is the conventional case, and $S_2$ shows the present embodiment. FIG. 10(A) is the secondary flow on the blade surface, FIG. 10(B) shows the effect of the secondary flow on the shroud surface upon the flow inside the blade. As is apparent from FIG. 10(A), for the conventional turbine $S_1$, there is a secondary flow rising up on the shroud side (toward the top of the blade) directed toward the blade outlet on the negative pressure surface $F_1$ side, but in the embodiment, the cut-away areas 33 inhibit the secondary flow, and the flow is on the hub side ($S_2$). Further, as shown in FIG. 10(B), in the conventional case $S_1$, the secondary flow is generated on the shroud surface side, but for the embodiment, the foregoing cut-away areas inhibits the secondary flow and the flow is on the positive pressure surface $F_2$ side.

Thus, on the inlet side (shroud, hub) of the turbine blades 3, the impact angle (incidence angle) of the gas is reduced, which not only reduces impact loss at the inlet to the turbine blades, but it inhibits the secondary flow.

By forming the angled cut-away area 33 on shroud side 36 and hub side 34 of the inlet edge surface 31 of turbine blades 3 in these embodiments, the diameters at both ends of the inlet edge surface 31, $D_1$ and $D_2$ are reduced from the center diameter $D_0$, and the relative angle of gas flow ($\beta$) flowing into the blades 3 in the height direction of said blades 3 by varying the size of the cut-away areas, it is possible to optimize the inlet edge surface 31 at both ends, i.e. shroud side 36 and hub side 34 to recess them toward the inside circumference, according to the gas flow distribution, and also to optimize the relative angle of gas flow ($\beta$) in the height direction of said blades 3. So doing makes it possible to maintain a constant gas impact angle (incidence angle) at the inlet to the turbine blades in the height direction of blades 3.

As described above, because the shape of the scroll has been flattened by structuring the scroll width ratio, the width of the scroll in the radial direction ($\Delta R$) and the width (B) in the direction of the axis of rotation to be: $\Delta R/B=0.3$ to 0.7, compared to the conventional scroll structure where the radial direction velocity at the scroll side walls near the square areas on both ends of the turbine blades is $\Delta R/B=1$, the formation of a three dimensional boundary layer is better inhibited. The flow loss caused by the gas flow which remains distorted in the height direction of the turbine blades as it flows onto said blades can be reduced.

Since the distribution of the radial direction velocity in the direction of the axis of rotation of the scroll had been made more uniform by reducing the radial direction velocity inside of the scroll, compared to the prior art, at the scroll side walls near the square ends of the turbine blades as the flow approaches those blades, which inhibits the formation of a three dimensional boundary layer, and reduces the flow loss caused by the gas flow which remains distorted in the height direction of the blades as it flows onto said blades.

Compared to the smooth surfaced side walls of conventional scrolls, the invention reduces the radial direction velocity at the side walls of the scroll near the square ends of the turbine blades by corrugating the side wall surfaces, which makes the radial direction velocity distribution in the direction of the axis of rotation of the scroll more uniform, and which inhibits the formation of a three dimensional boundary layer, while reducing the flow loss caused by the gas flow which remains distorted in the height direction of the blades as it flows onto said blades.

The invention reduces the wake generated at the tongue by forming the sectional area of the flow path at the downstream right after the tongue to be slightly smaller than the sectional area of the flow path at the end of the tongue, which makes it possible to reduce the wake generated at the tongue, resulting in also reducing the turbulence at the outlet from the scroll.

Further, the formation of a three dimensional boundary layer can be inhibited by reducing the width of the flow path at the downstream right after the tongue by an amount equal to the thickness (T) of the tongue, which reduces the flow loss caused by the gas flow which remains distorted in the height direction of the blades as it flows onto said blades.

As detailed above, the present invention, by means of forming an angled cut-away area on both the shroud side and hub side at the inlet edge surface of the turbine blades, makes it possible to recess both ends of the inlet edge surface of the blades to conform to the gas flow distribution at the inlet to the turbine blades, to optimize the relative inflow angle of the gas (β) in the height direction of the turbine blades.

The above structures make it possible to keep the impact angle (incidence angle) at the inlet to the turbine blades constant in the height direction of the blades to eliminate any impact loss at the inlet to the turbine blades, that accompanies variation in the relative inflow angle of the gas, and to prevent increased flow losses from secondary flows inside the blades as means to avoid declines in turbine efficiency.

Further, when structured as above, by matching the amount cut away from the inlet edge surface of the blades to at least the width of the three dimensional boundary layer, by having a length in the radial direction that is 10% to 20% of the height of the inlet edge surface as a means to eliminate the disparity in the relative gas inflow angle caused by the three dimensional boundary layer between the center area and the end areas (shroud side and hub side) of the inlet to the turbine blades, and to make constant the gas impact angle in the height direction of the blades at the blade inlet.

In sum, the present inventions make it possible to reduce the gas flow loss in the scroll and at the turbine blades, which improves turbine efficiency.

What is claimed is:

1. A structure of a turbine scroll used in a radial turbine in which operating gas flows through a vortex-shaped scroll formed inside a turbine casing to turbine blades of a turbine rotor positioned inside said turbine scroll, flowing into said blades in a radial direction to rotate the turbine rotor before flowing out, in the axial direction, wherein said turbine scroll has a scroll width ratio ΔR/B between the width in the radial direction (ΔR) and the width in the direction of the rotation (B) which ranges between 0.3 and 0.7, and wherein said width in the direction of the rotation (B) expands at a fixed rate from the outside circumference of the scroll in the radial direction toward the inside circumference of the scroll.

2. A structure of a turbine scroll used in a radial turbine in which operating gas flows through a vortex-shaped scroll formed inside a turbine casing to turbine blades of a turbine rotor positioned inside said turbine scroll, flowing into said blades in a radial direction to rotate the turbine rotor before flowing out, in the axial direction, wherein said turbine scroll has a scroll width ratio ΔR/B between the width in the radial direction (AR) and the width in the direction of the rotation (B) which ranges between 0.3 and 0.7, and wherein said width in the direction of the rotation (B) is formed so that the width of the inside circumferential edge of the scroll in the radial direction ($B_2$) is 1.2 to 1.5 times the width of the outside circumferential edge ($B_1$) of the scroll.

3. A structure of a turbine scroll used in a radial turbine in which operating gas flows through a vortex-shaped scroll formed inside a turbine casing to turbine blades of a turbine rotor positioned inside said turbine scroll, flowing into said blades in a radial direction to rotate the turbine rotor before flowing out, in the axial direction, wherein said turbine scroll has a scroll width ratio ΔR/B between the width in the radial direction (ΔR) and the width in the direction of the rotation (B) which ranges between 0.3 and 0.7 and wherein the side wall of said turbine scroll has a corrugated surface.

4. A structure of a turbine scroll used in a radial turbine in which operating gas flows through a vortex-shaped scroll formed inside a turbine casing to turbine blades of a turbine rotor positioned inside said turbine scroll, flowing into said blades in a radial direction to rotate the turbine rotor before flowing out in the axial direction, wherein the sectional area of the flow path at the downstream direction right after a tongue, formed at an inner circumference of a gas inlet is formed partially smaller than the sectional area of the flow path at the tongue edge by narrowing in the width direction in an amount corresponding to the thickness (T) dimension of the tongue.

5. A structure of a turbine scroll according to claim 4, wherein the width of the tongue's downstream side walls is formed partially narrower in an amount equal to the thickness (T) of said tongue than the width of the tongue edge side walls.

6. A structure of turbine blades in a radial turbine in which operating gas is allowed to flow radially through a spiraling scroll formed in a casing of the turbine into a turbine rotor positioned inside said scroll to act on a rotor blade of the turbine to rotate the turbine rotor and leave the rotor in an axial direction, wherein said rotor blade is formed such that an inlet edge of said rotor blade is shaped flat in a width direction in a middle portion thereof and cut-away obliquely linearly on both a hub side portion and a shroud side portion thereof, a length of said cut-away in the width direction is in a range from 10% to 20% of the width of the inlet edge, and a length $d_1$ of said cut-away in the radial direction in the hub side portion and a length $d_2$ in the shroud side portion are different from each other, thus a diameter $D_1$ of the blade in the hub side and a diameter $D_2$ of the blade in the shroud side are respectively decreased by $2d_1$ and $2d_2$ from a diameter $D_0$ of the blade in the middle portion so that the relations between the diameters result in $D_0>D_2>D_1$.

* * * * *